United States Patent [19]

Bollinger

[11] Patent Number: 4,519,475

[45] Date of Patent: May 28, 1985

[54] SCAFFOLDING

[75] Inventor: Karl Bollinger, Rueil Malmaison, France

[73] Assignee: Soletanche, Nanterre, France

[21] Appl. No.: 453,824

[22] Filed: Dec. 28, 1982

[30] Foreign Application Priority Data

Dec. 24, 1982 [FR] France ..... 82 21742

[51] Int. Cl.[3] ..... E04G 1/15; E04G 1/24

[52] U.S. Cl. ..... 182/17; 182/63

[58] Field of Search ..... 182/107, 63, 62.5, 141, 182/51, 52, 12, 17

[56] References Cited

U.S. PATENT DOCUMENTS

| | | | |
|---|---|---|---|
| 670,548 | 3/1901 | Sliger | 182/63 |
| 1,595,450 | 8/1926 | Christian | 182/51 |
| 3,243,123 | 3/1966 | Inghram | 182/51 |
| 3,432,003 | 3/1969 | La Pierre | 182/107 |

*Primary Examiner*—Reinaldo P. Machado

*Attorney, Agent, or Firm*—Robert Scobey

[57] ABSTRACT

Scaffolding that is intended for operations carried out at a certain height and involving horizontal forces as well as the recovery of these forces.

The scaffolding includes a tower (5) consisting of at least one liquid-tight element (6) that can contain liquid ballast (9), means (1) of supporting the tower on the ground, and an operations deck (8) at the top of the tower.

7 Claims, 2 Drawing Figures

1
2
2
3
4
5
6
6'
7
8
9
h 1
2
3
4
5
6
6'
7
8
9
10
F

SCAFFOLDING

The present invention concerns scaffolding especially intended for operations at a certain height above the ground level of a construction site and entailing certain horizontal forces, and for the recovery of these forces.

When drilling is carried out above ground level, scaffolding that supports the drilling equipment and is intended to recover any reaction to the horizontal forces that occur is generally employed.

These demands lead to fairly large scaffolding. Problems are always encountered when there is not much area available at the foot of the scaffolding, a situation that decreases the resistance of the scaffolding to any horizontal forces that occur above.

The invention is intended to eliminate these problems, and its object is scaffolding that is intended for operations carried out at a certain height and involving horizontal forces as well as the recovery of these forces, characterized in that it includes a tower consisting of at least one liquid-tight element that can contain liquid ballast, means of supporting the tower on the ground, and an operations deck at the top of the tower.

The amount of liquid needed to ballast the scaffolding without increasing the area of ground on which it rests can be calculated as a function of the height at which the operations are to be carried out and of the reaction to be recovered.

In one preferred embodiment of the invention the tower consists of several elements, specifically liquid-tight cylinders of the same height, one on top of another.

This allows the scaffolding to be erected to the desired height.

It is practical for the area of the operations deck to be greater than the cross-section of the tower to provide room for equipment and personnel.

The means of supporting the tower preferably consist of a carriage that moves, for example, along a supporting wall in which many holes are to be bored to install anchor rods.

The scaffolding may in this case include means of advancing the carriage.

Figure 2:
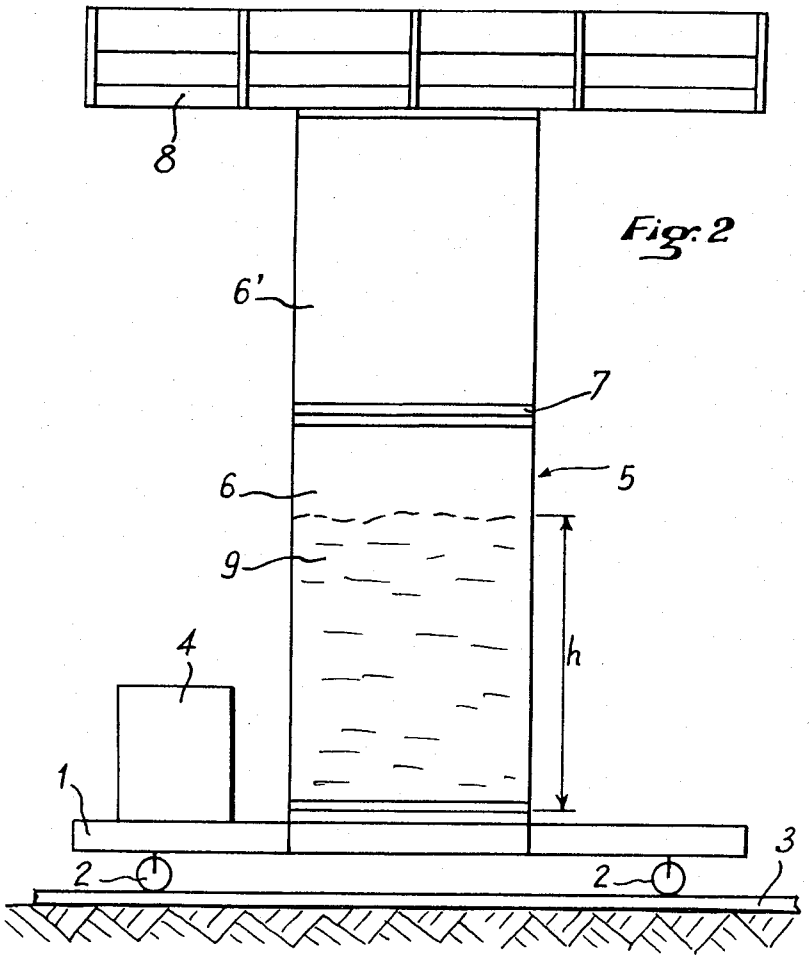
Figure 1:
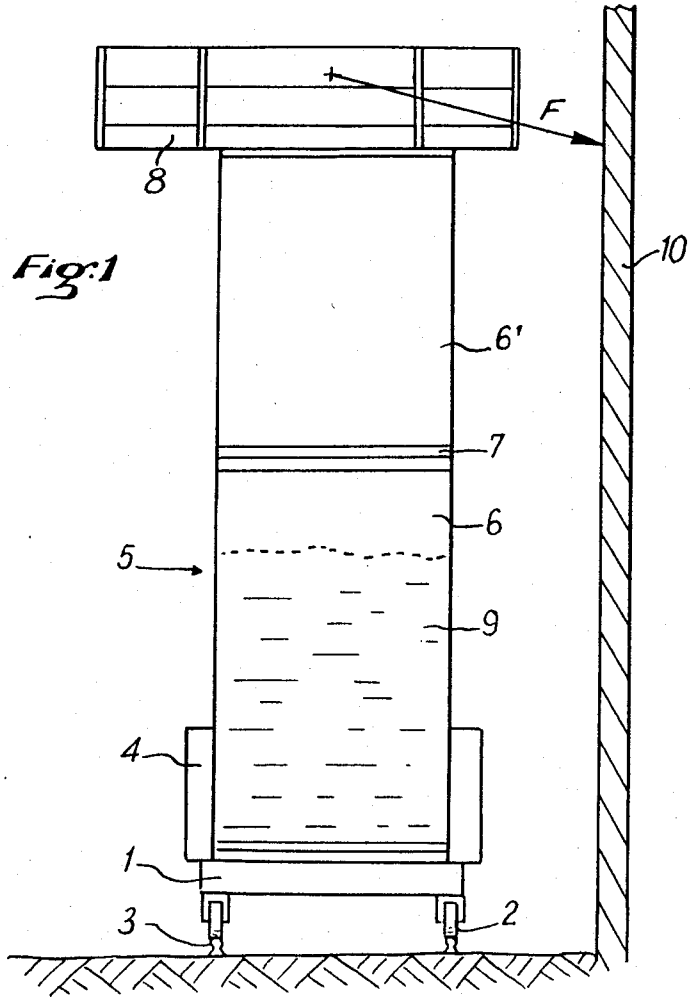

One embodiment of the invention will now be specified by way of example and without limiting it in any way with reference to the attached schematic drawing, in which FIG. 1 is a front view of a scaffolding in accordance with the invention and FIG. 2 is a side view of the scaffolding in FIG. 1.

The scaffolding in accordance with the invention includes a moving carriage 1 that travels on wheels 2 along rails 3.

A drive mechanism 4, which may for example be an electric assembly, powers the carriage wheels through a transmission system, not illustrated, to move it along the rails.

The scaffolding also includes a tower 5, consisting in this case of two liquid-tight cylindrical elements 6 and 6' that are joined at point 7 by any practical means.

Finally, an operations deck 8 is mounted at the top of tower 5 at approximately the level at which the operations are to be carried out.

The area of deck 8 is large enough to conveniently accommodate both the equipment necessary for the job and the operating personnel.

In the case illustrated, the scaffolding in accordance with the invention is intended for drilling operations on a wall 9. The corresponding force F subjects deck 8 to an equal and opposite reaction, which has a horizontal component that tends to make the scaffolding rock back and forth.

In known scaffolding this rocking motion is counteracted by making the base of the tower large enough to sustain it. The invention allows the motion to be counteracted even when the base area of the tower is relatively small.

Tower 5 is filled to an appropriate level with a ballast 9 for this purpose.

It is practical for this ballast to be a liquid like water, bentonite mud, or other liquid with a density above 1. It may be supplemented with solid ballasts like masses of lead or rocks positioned for example at the base of the tower.

The stability of the tower can also be easily ensured by leaving only a minimum area of ground. Furthermore, the scaffolding in accordance with the invention can easily be adapted to different operating heights by stacking elements 6 to an appropriate level.

Different variations and modifications can of course be made with respect to the scaffolding just described without departing in the least from either the scope or the theory of the invention.

Various elements of the tower may be designed to telescope for example.

A tower with a base of liquid-tight elements and a metal structure above them is also conceivable.

I claim:

1. Scaffolding that is intended for operations carried out at a certain height and capable of resisting horizontal forces comprising a tower formed from at least one vertically immovable liquid-tight element of substantially constant cross-sectional area that can contain liquid ballast sufficient for resisting horizontal forces carried out at said certain height, means for supporting the tower on the ground, and an operations deck at a fixed height at the top of the tower at said certain height and supported directly by said at least one vertically immovable liquid-tight element for performing operations that result in said horizontal forces.

2. Scaffolding as in claim 1, characterized in that the tower consists of several liquid-tight elements of the same height, one on top of another.

3. Scaffolding as in claim 1 or 2, characterized in that the area of the deck is greater than the cross-section of the tower.

4. Scaffolding as in any of claims 1 or 2, characterized in that the means of supporting the tower consists of a moving carriage.

5. Scaffolding as in claim 4, characterized in that it includes means for advancing the carriage.

6. Scaffolding as in claim 3, characterized in that the means of supporting the tower consists of a moving carriage.

7. Scaffolding as in claim 6, characterized in that it includes means for advancing the carriage.

* * * * *